United States Patent [19]

Moore

[11] Patent Number: 4,511,302

[45] Date of Patent: Apr. 16, 1985

[54] MACHINE FOR DISLODGING CANS FROM A COMPRESSED BALE OF CANS

[75] Inventor: Joseph Moore, St. Louis, Mo.

[73] Assignee: Hustler Conveyor Company, St. Louis, Mo.

[21] Appl. No.: 481,571

[22] Filed: Apr. 1, 1983

[51] Int. Cl.[3] ..... B65G 65/42

[52] U.S. Cl. ..... 414/327; 241/101 A

[58] Field of Search ..... 414/304, 327, 416, 412; 198/547, 616, 688, 698; 241/101 A; 19/81

[56] References Cited

U.S. PATENT DOCUMENTS

| | | | |
|---|---|---|---|
| 2,748,993 | 6/1956 | Forrest | 222/415 |
| 2,792,183 | 5/1957 | Fasching et al. | 241/101 A X |
| 4,192,042 | 3/1980 | Jagst | 241/101 A X |

*Primary Examiner*—Robert G. Sheridan

*Attorney, Agent, or Firm*—Gravely, Lieder & Woodruff

[57] ABSTRACT

A machine for dislodging cans from a tightly packed bale of such cans has a cavity and an endless track at the bottom of the cavity. The bale is placed in the cavity and allowed to rest on the track. When the track moves, lugs which project outwardly from it, bite into the bale and strip cans from the bale.

11 Claims, 4 Drawing Figures

MACHINE FOR DISLODGING CANS FROM A COMPRESSED BALE OF CANS

BACKGROUND OF THE INVENTION

This invention relates in general to material handling and more particularly to a machine dislodging items from tightly packed bundles of materials.

A market exists for empty aluminum beverage cans of the type in which beer and soft drinks are sold, because these cans may be melted and converted into high grade aluminum suitable for producing more cans or other aluminum products. Usually an individual brings the cans to a recycling center where they are collected in large quantities. The recycling center or a later processor flattens the cans and then compresses them into bales which measure approximately 4 ft×4 ft×5 ft and have a density of between 15 and 20 lbs/ft$^3$. The bales are transported to a smelter where they are broken apart and introduced into a furnace.

Of course the bales themselves are much too large to be introduced as a whole into the furnace, and as a consequence the cans must be separated from them and fed gradually into the furnace. Heretofore, breaking the bales down has to a large measure been a manual operation. As such it is expensive, and much worse the flattened cans do not totally separate, so that more often than not clumps of cans are fed into the furnace. These clumps, although they eventually melt, disrupt the operation of the furnace in that they tend to create heat sinks and interfere with furnace mixing equipment. It is much more desirable to feed totally separated cans into the charging well of a furnace on a generally uniform basis.

Sometimes the flattened cans are immersed in a solvent to remove lacquer before they are introduced into a furnace. In order for the delacquerization process to be effective, the cans must not be compressed together in clumps, but instead must be totally separated.

SUMMARY OF THE INVENTION

One of the principal objects of the present invention is to provide a machine for breaking apart bundles or bales composed of tightly packed items. Another object is to provide a machine of the type stated which separates the individual items from the bundle or bale and totally from one another as well. A further object is to provide a machine of the type stated which is ideally suited for separating beverage cans from a bale composed of such cans. An additional object is to provide a machine of the type stated which totally separates beverage cans so that they do not cling together in clumps. Still another object is to provide an improved process for breaking down tightly packed bundles or bales of items, such as beverage cans. These and other objects and advantages will become apparent hereinafter.

DESCRIPTION OF THE DRAWINGS

In the accompanying drawings which form part of the specification and wherein like numerals and letters refer to like parts wherever they occur—

DETAILED DESCRIPTION

Figure 1:
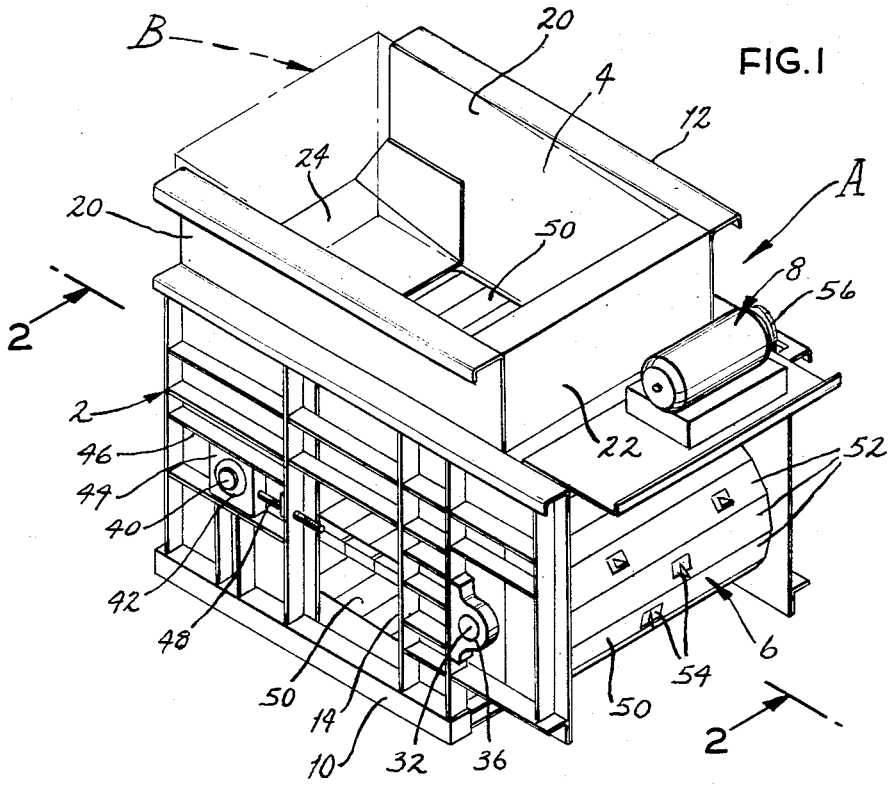
FIG. 1 is a perspective view of a machine constructed in accordance with the present invention for dislodging flattened cans from a tightly packed bale of such cans, the bale being illustrated in phantom.
Figure 2:
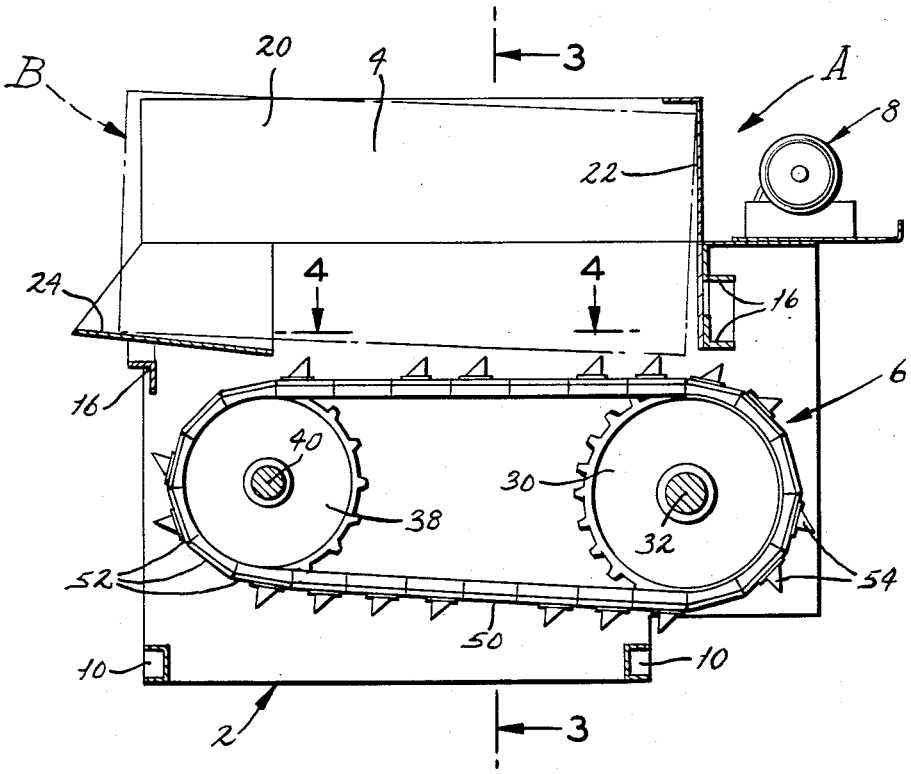
FIG. 2 is a sectional view taken along line 2—2 of FIG. 1.

Referring now the drawings, a machine A (FIGS. 1 and 2) accepts a bale B (FIG. 2) of beverage cans and strips or dislodges the cans from the bottom of the bale B, so that the cans which are discharged near the bottom of the machine A are separated from the bale B and from one another. Accordingly, they may be fed into the charging well of aluminum smelting furnace one at a time or more likely as a steady stream. In this way the cans do not present a large heat sink which may freeze some of the melt, nor do they interfere with equipment such as mixers that may be in the charging well. Within the bale B the individual cans are flat and may be packed tight enough to give the bale a density of 15 and 20 lbs/ft$^3$. A typical bale measures approximately 4 ft×4 ft×5 ft.

The machine A basically includes (FIGS. 1 and 2) a frame 2 which contains an upwardly opening cavity 4 into which is large enough to receive a bale B that is to be broken apart, a stripper assembly 6 located on the lower portion of the frame 2 for stripping cans from the bottom of a bale B that is in the cavity 4, and motor 8 that is likewise supported on the frame 2 and supplies the power for operating the stripper assembly 6.

The frame 2 has a base section 10 (FIG. 1) which rests on a foundation or floor and left and right side sections 12 and 14 which extend upwardly from the base section 10. All three sections 10, 12 and 14 are weldments formed from common steel shapes such as tubes, channels, angles and plates. The side sections 12 and 14 are connected above the stripper assembly 6 by several cross members 16, most of which are in front of the cavity 4, although one is at the rear of the cavity 4.

Figure 3:
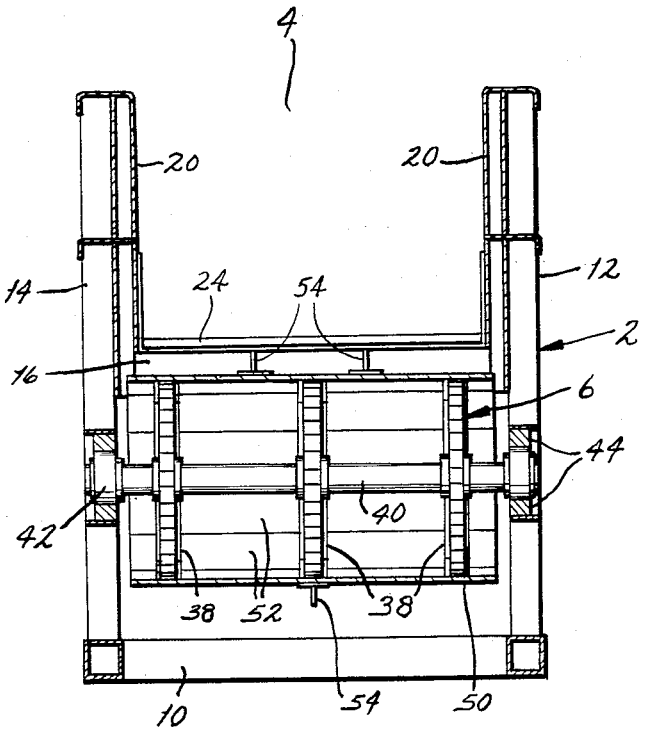
FIG. 3 is a sectional view taken along line 3—3 of FIG. 2.

Attached to the left and right sections 10 and 12 of the frame 2 are side walls 20 (FIGS. 1–3) which line the sides of the cavity 4. As such the side walls 20 are parallel and spaced far enough apart so that a bale B will fit easily between them. The side walls 20 project forwardly beyond the front of the cavity 4 and in this region also extend below the cavity 4. The cross members 16 at the front of the frame 2 have a front wall 22 attached to them, and this wall extends between the two side walls 20 and closes the front of the cavity 4. The top of the cavity 4 is open, as is the rear, while the stripper assembly 6 forms the bottom of the cavity 4. At the rear of the cavity 4 is a short chute 24 which is supported on one of the cross members 16 and projects rearwardly from the side sections 12 and 14 of the frame 2. The chute 24 is inclined downwardly toward the stripper assembly 6.

The stripper assembly 6 (FIGS. 2 and 3) closes the bottom of the cavity 4 and provides the surface on which a bale B rests when lowered into the cavity 4. The stripper assembly 6 includes several head sprockets 30 located on a common shaft 32 that extends across the frame 2 and is at its ends supported by bearings 34 (FIG. 1) which are bolted in a fixed position to the side sections 12 and 14 of the frame 2. In addition, the stripper assembly 6 includes several tail sprockets 38 (FIG. 3) which are located to the rear, yet align with, the heat sprockets 30, and like the sprockets 30 they are mounted on a shaft 40 which extends entirely across the frame 2. Indeed the ends of the rear shaft 40 fit into bearings 42 that are carried on slides 44 (FIG. 1) within a slideway 46. The position of each bearing 42 along its slideway is controlled by an adjusting screw 48. Extended around the sprockets 30 and 38 is an endless device or track 50 that resembles the track of a crawler-type tractor. As such it is composed of a series of rigid links 52 which are connected together at pins so that the track 50 pivots at joints between adjacent links 52. The track 50 occupies almost the entire space between the lower ends of the side walls 20, and the front and rear shafts 32 and 40 are positioned such that the upper pass of the track 50 is generally horizontal. The lower pass, on the other hand, is immediately above base section 10 of the frame 2. Indeed, the upper pass of the track 50 is exposed to the cavity 4 and constitutes the lower surface of the cavity 4, and it is that surface on which the bale B ultimately rests when it is lowered into the cavity 4.

Figure 4:
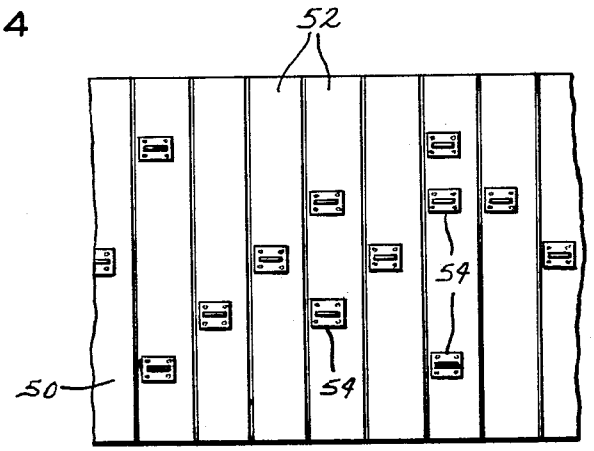
FIG. 4 is a fragmentary plan view of a track segment showing the random placement of lugs upon it.

Some of the links 52 have lugs 54 bolted or otherwise attached to them, and these lugs project from about 3 to 6 inches beyond the major surface area on the outside of the track 50. While the lugs 54 project outwardly from the track 50, they are short enough so as to pass beneath all of the cross members 16 for the frame 2, and likewise do not interfere with the base section 10. The lugs 54 are arranged in somewhat of a random pattern, or at least in a pattern which prevents a lug 54 from tracking with respect to the lug 54 that immediately precedes it (FIG. 4). Thus, as the track 50 moves along the bottom of the cavity 4 and against the underside of the bale B in that cavity 4, the lugs 54 will bite into the bale B at different locations.

The motor 8 (FIG. 1) is mounted on the frame 2 ahead of the front wall 22 and includes a gear reducer. It is coupled to the front shaft 32 through a sprocket and chain drive 56. The motor 8 rotates the shaft 32 and of course rotates the head sprockets 30 that are on the shaft 32. The sprockets 30 in turn move the track 50, such that the upper pass of the track 50 advances toward the front wall 22.

In order to break down the bale B so as to separate the flattened cans that comprise that bale from the general mass of the bale B, the bale B is lifted upwardly and then lowered into the cavity 4 of the machine A. This may be done with a hoist or with a fork lift truck. It is not necessary to remove banding, although it is desirable from the standpoint that it prevents the steel banding from becoming intermingled with the aluminum can scrap. Moreover, it is not necessary to position the bale B against the front wall, but it is acceptable to have one end of it rest on the track 50 and the other end on the chute 24.

Once the bale B is in the cavity, the motor 8 is energized, and it turns the front shaft 32 and the head sprockets 30 on the shaft. The sprockets 30 in turn engage the track 50, causing it to move between the sprockets 30 and 38 on the shafts 32 and 40, respectively. The upper pass of the track 50 supports the bale B inasmuch as it forms the bottom of the cavity 4, and that pass moves from the rear or tail sprockets 38 to the front or head sprockets 30. If the bale B is not against the front wall 22, the moving track 50 will take it there.

The front wall 22 restrains the bale B, but not the lugs 54 on the track 50 that is beneath the bale B. As a consequence, the lugs 54 move through the bottom of the bale B and strip or otherwise dislodge flattened cans at that location. The track 50 pulls these cans out from underneath the bale B and discharges them at the front of the machine A where they will accumulate. Since the lugs 54 do not align, they enter the bale B at different locations along its underside, and the cans are stripped generally evenly from the bale B. The weight of the bale B keeps the bale B against the track 50 and insures that the lugs 54 bite deeply into it.

The cans upon emerging from the machine A do not cling together in clumps, but instead are totally separated from each other. As a result the cans may be fed individually into a furnace or through a delacquerization process.

The machine A may be used to break items other than cans away from densified bundles or bales in which such items may be packed or otherwise contained.

This invention is intended to cover all changes and modifications of the example of the invention herein chosen for purposes of the disclosure which do not constitute departures from the spirit and scope of the invention.

What is claimed is:

1. A machine for disloding cans from a bale composed of such cans, said machine comprising: a frame; first and second shafts supported on the frame and having wheels thereon, the shafts being horizontal and parallel and being mounted such that their axes are fixed in position with respect to the frame; an endless track extended around the wheels and being engaged with at least one of the wheels such that when that wheel turns, it causes the track to move, the track being positioned such that one of its passes is presented upwardly; lugs projecting outwardly from the endless track; means on the frame for turning the shaft on which are mounted the wheels for engaging the track, whereby the track will move around the wheels of the first and second shafts; side walls mounted on the frame and projecting upwardly generally at the sides of the upwardly presented pass of the track; and a front wall located above the track and extending between the side walls such that the upwardly presented surface of the track moves toward and passes beneath the front wall, the front wall together with the side walls forming a cavity which is located above the upwardly presented pass of the track, with the cavity being open at its top and also at its end that is remote from the front wall whereby a bale of cans may be inserted into the open end of the cavity and placed between the side walls where it is over the upwardly presented surface of the track, so that the lugs will urge the bale against the front wall and will further pass through the underside of the bale to dislodge cans from the bale.

2. The machine according to claim 1 and further comprising a chute attached to the frame and projecting out of the open end of the space between the two side walls, the chute being inclined downwardly toward the upwardly presented pass on the track.

3. A machine for dislodging items from a densified bundle of such items, said machine comprising: a frame; an endless track supported on the frame such that it has one pass which is presented upwardly; means supported on the frame for moving the track relative to the frame without changing its location on the frame; lugs attached to the track such that they project outwardly therefrom, whereby the lugs project generally upwardly along said one upwardly presented pass of the track; and walls mounted on the frame to provide a cavity above said one pass of the track, said walls including a front wall which extends over and across said one pass of the track such that said one pass for the most part moves toward and beneath the front wall, said walls also including side walls which extend rearwardly from the front wall generally along the sides of said one pass, the cavity being open at its top and also between the side walls at their ends that are remote from the front wall, so that the cavity opens both upwardly and rearwardly, whereby a densified bundle of items may be inserted into the rear open end of the cavity and deposited on said one pass of the track, so that the lugs urge the bundle toward the front wall and strip the items from the bottom of the bundle, enabling them to be carried out of the cavity on the track.

4. The machine according to claim 3 wherein said one pass of the track is disposed generally horizontally and moves along the bottom of the cavity, whereby the bundle rests on said one pass.

5. The machine according to claim 3 and further comprising a chute supported on the frame and being directed into the open end of the cavity opposite the front wall.

6. The machine according to claim 5 wherein the chute is inclined downwardly toward said one pass of the track.

7. The machine according to claim 3 wherein the track is composed of rigid links that pivot relative to each other, and the lugs are on the links.

8. The machine according to claim 3 wherein the lugs are arranged such that no lug aligns with the lug immediately preceeding it, whereby the lugs do not track as they pass through the bundle.

9. A machine according to claim 3 and further comprising a chute which extends generally between the side walls at the open rear end of the cavity and is located slightly above said one pass of the track.

10. A machine according to claim 9 wherein the chute slopes downwardly toward said one pass of the track.

11. A machine according to claim 9 wherein the chute projects rearwardly beyond the track.

* * * * *